US005238075A

United States Patent [19]

Keith et al.

[11] Patent Number: 5,238,075

[45] Date of Patent: Aug. 24, 1993

[54] DRILL BIT WITH IMPROVED CUTTER SIZING PATTERN

[75] Inventors: Carl W. Keith, Spring; Robert I. Clayton, Deer Park, both of Tex.

[73] Assignee: Dresser Industries, Inc., Dallas, Tex.

[21] Appl. No.: 901,322

[22] Filed: Jun. 19, 1992

[51] Int. Cl.[5] ..... E21B 10/46

[52] U.S. Cl. ..... 175/431; 175/435

[58] Field of Search ..... 175/431, 425, 426, 428, 175/430, 435

[56] References Cited

U.S. PATENT DOCUMENTS

| | | | |
|---|---|---|---|
| 3,747,699 | 7/1973 | Feenstra et al. | 175/434 |
| 4,420,050 | 12/1983 | Jones | 175/374 |
| 4,429,755 | 2/1984 | Williamson | 175/329 |
| 4,586,574 | 5/1986 | Grappendorf | 175/434 |
| 4,602,691 | 7/1986 | Weaver | 175/430 |
| 4,889,017 | 12/1989 | Fuller et al. | 175/428 X |
| 4,913,244 | 4/1990 | Trujillo | 175/429 X |
| 4,932,484 | 6/1990 | Warren | 175/398 X |
| 4,940,099 | 7/1990 | Deane et al. | 175/374 |
| 5,028,177 | 7/1991 | Meskin et al., | 175/430 X |
| 5,033,560 | 7/1991 | Sawyer et al. | 175/431 |

*Primary Examiner*—Stephen J. Novosad

[57] ABSTRACT

A fixed cutter drill bit includes a plurality of angularly spaced radial wings each with a row of cutting elements mounted thereon and protruding from the bit for drilling through formation material. On a first of the wings, a first row of the cutting elements has alternately larger and smaller area cutting faces at spaced selected radial positions relative to the center of the bit. Similarly, a second row of cutting elements is mounted on a second of the wings at substantially the same radial positions but with the radial positions of the larger and smaller cutting faces reversed over those on the first wing. A third wing includes a third row of cutting elements with cutting faces of intermediate area located at each of the selected radial positions. The combination of different sizes of cutting elements at each radial position defines a set having a profile with the intermediate and smaller cutting elements located entirely within the larger cutting element. The profiles of the larger cutting elements of adjacent sets overlap each other without substantial overlapping of the profiles of any of the other cutting elements.

22 Claims, 2 Drawing Sheets

DRILL BIT WITH IMPROVED CUTTER SIZING PATTERN

BACKGROUND OF THE INVENTION

1. Technical Field

This invention relates generally to fixed cutter drill bits of the type used in cutting through rock formation such as when drilling for oil or the like. More particularly, this invention is concerned with the arrangement of the cutter elements which are mounted on the face of the drill bit.

2. Background Information

Typically, fixed cutter bits include cutting elements protruding from the face of a drill bit body and cutting edges of the cutter elements are arranged to define a cutting profile extending generally radially outward from the center of the bit. The cutting elements are placed at selected radial positions with respect to the central axis of the bit so that each element cuts a groove or kerf in the formation as the bit is rotated. In a usual arrangement, the profile of the cutting elements is such that the cutting edges of adjacent elements overlap each other on progressing radially outward from the central axis of the bit. As the cutting edges of the individual elements are worn during drilling, they tend to assume a profile presenting a relatively flat and single continuous cutting edge from one element to the next. This wear, of course, effects the penetration rate at which the bit effectively drills.

One example of a prior art bit is shown in U.S. Pat. No. 5,033,560 which discloses a fixed cutter bit having radial wings with different sizes of cutting elements in each of the wings. However, at any one radial position, all of the cutting elements are of the same size. In U.S. Pat. No. 4,602,691 (RE 33,757), there is disclosed a fixed cutter bit utilizing cutting elements of different sizes and shapes. Specifically, sharp elements at spaced radial positions cut small relief kerfs in the formation. Thereafter, round or blunt cutting elements follow at an adjacent radial position and dislodge the formation between the kerfs.

U.S. Pat. No. 4,913,244 discloses different sizes of cutters at different radial positions. Large diameter cutters are located between the central axis of the bit and gage. Smaller diameter gage cutters are located at the periphery of the bit body.

SUMMARY OF THE INVENTION

The primary aim of the present invention is to provide a novel arrangement of differing relative sizes of cutter elements so that even as the bit wears a cutting edge with an aggressive cutting tip is effectively maintained or improved at each radial position for cutter elements in the rotated profile of the bit. More specifically, the present invention aims to accomplish the foregoing by arranging cutting elements in sets of different sizes at each radial position so that the sides of the cutting elements from one radial set to the next wear at rates which maintain or create aggressive cutting tips at each radial position for drilling through the formation even as the cutting elements wear.

More particularly, the invention herein resides in the provision of a set of large and smaller diameter cutting elements at each radial profile position where at the smaller diameter cutting element profiles are contained entirely within the profile of the large diameter cutting element. Moreover, as between adjacent sets, only the large diameter cutting elements overlap each other in profile.

One additional advantage of the present invention is that, as the cutting tip of the bit wears, greater stabilization is achieved against bit wobble.

The foregoing and other advantages of the present invention will become more apparent from the following description of the best mode for carrying out the invention when taken in conjunction with the accompanying drawings.

BEST MODE FOR CARRYING OUT THE INVENTION

Figure 1:
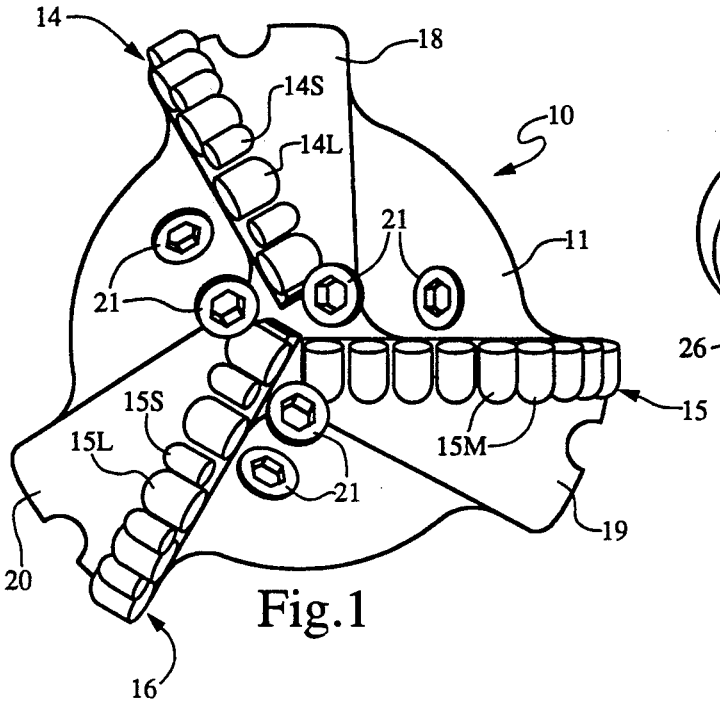
FIG. 1 is a plan view of the end of a fixed cutter drill bit embodying the novel features of the present invention.

As shown in the drawings for purposes of illustration, the present invention is embodied in a fixed cutter bit 10 having a body 11 with a nose portion 13 containing a plurality of cutter elements 14, 15 and 16 mounted thereon for drilling through formation material. Specifically herein, the elements are mounted in radially extending rows upon three generally radially extending wings 18, 19 and 20, respectively. The wings are integrally formed with the face of the body, extending outwardly from the center portion of the nose adjacent the rotational axis 24 of the bit. Between the wings are nozzles 21 connecting with an internal passage 23 (see FIG. 2) extending through the drill bit body and connecting with a drill string. Drilling fluid supplied through the drill string and passage exit the nozzles and is directed into the space between the wings and across the wings to wash away formation cuttings from in front of the cutting elements 14, 15 and 16 as the bit is rotated.

Figure 2:
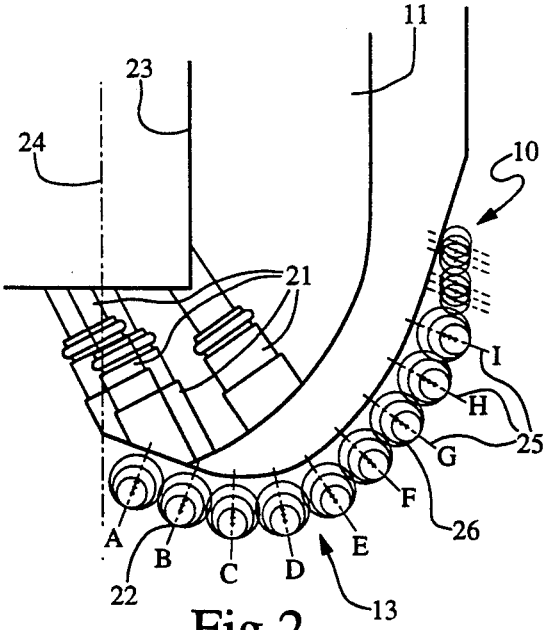
FIG. 2 is an elevational view of the drill bit of the present invention with the cutting elements shown in rotated profile collectively on one side of the central axis of the drill bit.
Figure 3:
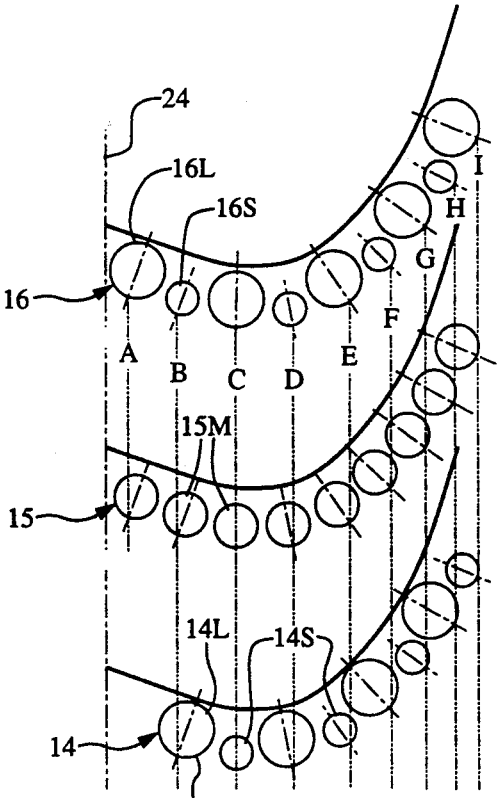
FIG. 3 is an elevationally separated schematic view showing the profile radial positions of the cutting elements of each wing relative to the central axis of the bit.

In order to cut into the rock formation, the cutting elements 14, 15 and 16 are mounted on the wings 18, 19 and 20 in selected radial positions relative to the central axis 24 of the bit 10. As shown in FIG. 2, the cutting elements at common radial positions are identified by common alphabetical indications. Specifically, each of the cutters is positioned with an axis 25 thereof extending normal to the face of the bit so that tips 22 of the cutting edges 26 of the elements at each radial position align with each other in rotated profile. Herein, the tip of a cutting element is the portion or point of the cutting edge which normally is lowermost or along the line of maximum normal force applied to the formation while being cut by the cutting element. In the exemplary form of the invention illustrated in FIGS. 1–4, as the bit is turned, the wings sweep around the bottom of the borehole being cut with the cutting elements in each of the radial positions serving to cut a trough or kerf within the formation.

In accordance with the primary aim of the present at each of the selected radial positions for the cutters 14, 15 and 16 throughout the wear service life of the drill bit 10. This is accomplished by using a set of different sizes of cutting elements ranging from having small to large diameter cutting faces at each radial position and spacing the adjacent positions from each other so that only a portion 29 of the faces of the large diameter cutting elements overlap in profile (see FIG. 4). In this way, a portion 27 of the sides of the large diameter cutting elements outside of the overlapped portions 29 wear more quickly than the tips of the cutting elements. Advantageously, this keeps the tips of the cutting elements in each set fairly sharp for aggressively cutting into the formation and maintaining a high rate of penetration throughout the service life of the bit. It will be appreciated that this is a substantial advantage over arrangements of redundant cutting elements of common size in that as the elements wear a smooth contour tends to form in the cutting profile. Without the formation of ridges in the bottom of a borehole between adjacent radial positions of cutting elements, the full length of the cutting edges of each of cutting elements are forced to attack the highly compressed formation material.

In the present instance, the wing 18 (see FIGS. 1 and 3) includes alternating large and small cutting elements 14L and 14S located at radial positions B through I, respectively. On wing 19, intermediate size cutting elements 15M are located at each of the radial positions A through I and on wing 20 the cutting elements are again alternated between large and small but with a large diameter cutting element in position A. Thus, in considering the exemplary profile position C shown in FIG. 3, as the bit is rotated and beginning with the cutters 14, a groove or kerf is cut in the formation first with a small diameter cutter 14S then the large diameter cutting element 16L.

Herein, the small, intermediate and large diameter cutting elements have cutting faces that are ½", ¾", and 1" diameter sizes. At the working tip end of each set of cutting elements, the cutting edges have different working lengths or swaths, depending upon the diameter of the cutting faces. Thus, the cutting edges for the small, intermediate and large cutting faces have cutting edges spanning respectively small, intermediate and large swaths.

Figure 4:
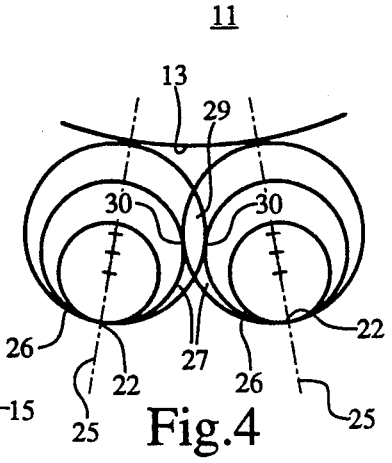
FIG. 4 is an enlarged view of a portion of FIG. 2 showing the overlapping of radially adjacent sets of cutting elements.

More particularly, the cutting faces in rotated profile for each set of cutting elements are centered along a common axis 25 with so that the lowermost portion or tip 22 of the cutting edge 26 of each face is spaced the same distance from the face of the bit when intersecting with the axis 25. Moreover, the axes 25 of adjacent sets of the cutting faces are spaced radially from each other so that only the large diameter cutting elements overlap in profile. As shown in FIG. 4, the radial spacing between adjacent cutting element axes 25 is such that each of the cutting edges of the large diameter cutting elements is generally intermediate diameter cutting element. In FIG. 4, this point of tangency is indicated represented by the reference number 30. As a result, for adjacent larger diameter cutting elements, there exists the oval-shaped overlap wear area indicated by the reference number 29. Adjacent this double wear area are two wing-shaped areas of single wear indicated by the reference number 27.

Advantageously, with the foregoing described arrangement of sets of three different sizes of cutting elements 14, 15 and 16 at each radial position, the cutting edges 26 of the cutting elements are maintained as aggressive cutting edges during drilling. This is because wear of the cutting elements is dictated directly by the amount of cutting edge material available to be worn away during drilling. With the concentration of cutting edge material from each of the small, intermediate and large diameter cutting elements at the discrete radial positions of the axes 25, wear at these radial positions is less than between the axes 25 where the cutting elements do not overlap and less material is available to resist wear. Thus, in the single wear areas 27, the sides of the larger cutting elements become worn while the tips 22 of the cutting edges remain fairly sharp to aggressively cut into the formation material.

Figure 5:
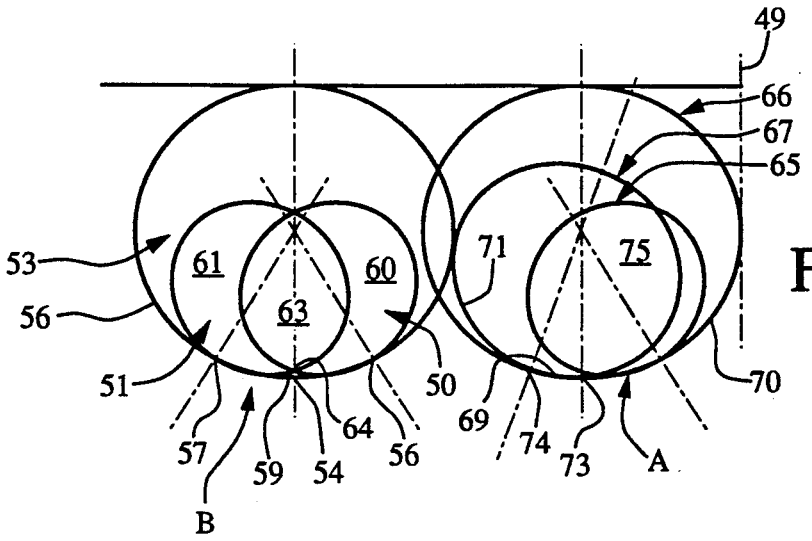
FIGS. 5, 6 and 7 are views similar to FIG. 4 showing alternative embodiments of the present invention.
Figure 6:
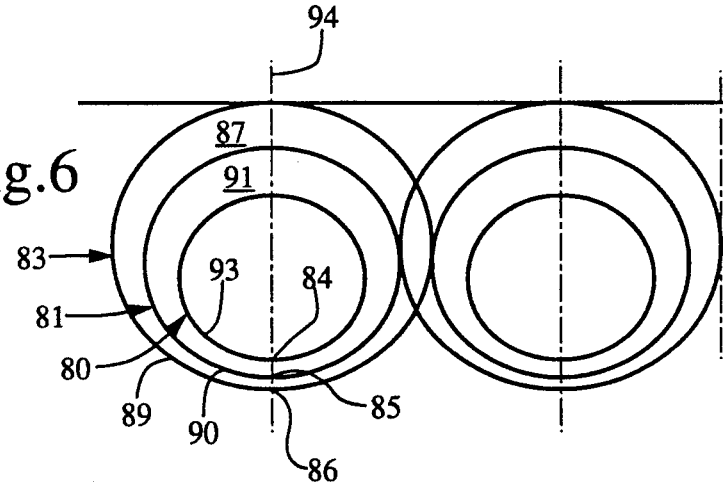
Figure 7:
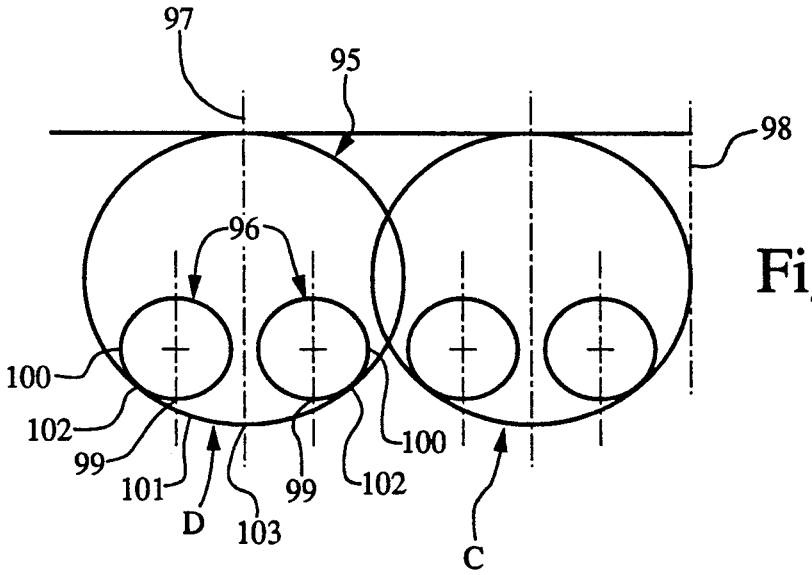

Alternate forms of the present invention are shown schematically in FIGS. 5–7 in generally the same manner as FIG. 4 with it being understood that the sets of cutting elements as herein described are representative of any one or number of sets of cutting elements that may be located on the face of a bit in a radical position relative to the axis of the bit. With reference specifically to FIG. 5, the profiles of two schematically in radially spaced positions relative to a bit axis 49. In the radially outermost set B, smaller cutting elements 50 and 51 are arranged in radially spaced positions relative to the axis of the bit with approximately one-half of the profile of the element 50 overlapped with the profile of the element 51. Moreover, the profiles of the elements 50 and 51 are both positioned within the profile of a large cutting element 53. A tip 54 of the cutting edge 56 of the large cutting element 53 is aligned radially between the tips 56 and 57 of the smaller cutting elements 50 and 51, respectively. As a result, an area 59 of single wear exists at the tip of the larger crescent shaped portions of the profiles of the smaller cutting elements 50 and 51 which do not overlap each other. Within the portion of the profiles of the smaller cutters which are overlapped with each other, there exists an oblong area 63 of triple wear. By virtue of this arrangement, when setting down and initially drilling with the bit, the set B is believed 59 is worn away quickly with the double wear areas 60 and 61 and the tips 56 and 57 of the smaller cutting elements 50 and 51 functioning in a stabilizing manner on opposite sides of a ridge formed therebetween in the formation. As the double wear areas 60 and 61 are worn, a new aggressive triple wear tip 64 is formed at the lower end of the triple overlap profile area 63 and maintained over a substantial portion of the service life of the bit.

As an illustration of the positioning of different sizes of cutting elements within the profile of the larger cutting element in order to provide increased resistance to wear at specific locations, the cutter set A in FIG. 5 is spaced radially inwardly of the cutter set B and includes at least one smaller diameter cutter 65 at one radial position within the profile of a larger cutter 66 and a cutting element 67 of intermediate diameter in profile. Effectively a double wear cutting edge 69 is defined by the overlapping cutting edges 70 and 71 of the large and intermediate sized cutting elements 66 and 67, respectively, centered between the tips 73 and 74 of those two cutting elements. A triple wear area 75 is defined by the overlapped portions of the profiles of all three cutting elements 65, 66 and 67.

Another profile wear arrangement is shown in FIG. 6 with the profile of small, intermediate and large diameter cutting elements 80, 81 and 83, respectively, are overlapped each other without initial overlapping of any of the respective cutting edge tips 84, 85 and 86. With this arrangement, in the profile area 87 between the cutting edge 89 of the large diameter cutting element and the cutting edge 90 of the intermediate size cutting element 81 an area of single wear exists. Similarly, the profile area 91 between cutting edges 93 and 90 of the smaller and intermediate cutting elements 80 and 81, respectively, represents an area of double wear. In this arrangement, the tips 84, 85 and 86 of the cutting edges 93, 90 and 89 are aligned along a common axis 94 and are spaced from each other progressively closer to the face of the bit body as the size of the cutting element becomes smaller. Thus, initial wear of the cutting elements in the sets shown in FIG. 6 is rapid and wear decreases upon progressing axially toward the face of the bit. At the same time, the area of wear in profile becomes smaller and more concentrated along the axis 94 so as to defining an increasingly more aggressive cutting tip as the elements wear toward the face of the bit.

Still another cutting element profile pattern arrangement is shown in FIG. 7 with two representative radially spaced sets C and D of large and smaller cutting elements 95 and 96, respectively. In each of the sets of this arrangement, the profiles of two of the smaller cutting elements 96 are shown enclosed within the profile of a larger cutting element 95. Specifically, within each set, the two smaller cutting elements are of the same size, each being equally spaced from the axis 97 of the larger cutting element, one of the smaller cutting elements being spaced toward the axis 98 of the bit and the other being spaced away large cutter element. Moreover, the tips 99 of the cutting edges 100 are spaced toward the face of the bit from the cutting edge 101 of the large cutting element. On each side of the large cutting element, a portion 102 of the cutting edge of one of the smaller cutting elements is coincident with the side of the cutting edge 101 of the large cutting edge. Thus, as the cutting elements in each of the sets of this arrangement are initially drilled into formation material, the large cutting element 95 is worn quickly at its tip 103 and thereafter aggressive cutting edge tips 102 of overlapped portions of the large and smaller cutting elements are formed.

In view of the foregoing, it will be appreciated concept for arranging different sizes of cutting elements on the face of a bit so that as the bit is worn, the tips of the cutting element wear in a manner so as to create or improve an aggressive cutting tip at each radial position of a set of different sizes of the cutting elements. While the alternative embodiments of the present invention as described above generally referred to the profile of a single cutting element of a particular size, small, intermediate or large, it will be appreciated that the representative profile included within the drawings are more likely to be redundant numbers of cutting elements of each size located at any one radial position for a particular size of cutting element. Accordingly, the wear area at any one radial position such as the single, double, and triple areas referred herein are meant to identify only the number of overlapping profiles of a particular size of cutting element rather than to refer to the number of cutting elements that may exist at any one radial position.

I claim:

1. A fixed cutter drill bit having a body with a nose portion thereof containing a plurality of angularly spaced generally radial wings, a first of said wings including a first row of cutting elements mounted thereon upon progressing radially outward from a center of said nose portion toward a periphery of the body of the bit, said first row of cutting elements having alternately larger and smaller area cutting faces at spaced radial positions along said first wing relative to the center of said nose, a second of said wings having a second similar row of cutting elements of larger and smaller area cutting faces thereon in substantially the same but reversed radial positions with respect to the relative radial placement of the larger and smaller diameter cutting faces of said elements in said first wing.

2. A drill bit as defined in claim 1 including a third generally radial wing angularly disposed on the nose of said bit body with respect to the first and second radial wings, said third wing having a third row of cutting elements mounted thereon, said third row of cutting elements having cutting faces of intermediate area relative to the sizes of said first and second cutting faces elements and disposed in common radial positions with respect to said first and second cutter element.

3. A drill bit as defined by claim 2 wherein in rotated profile radially adjacent ones of said larger area cutting faces include portions overlapping each adjacent ones of said other area cutting faces.

4. In a fixed cutter drill bit having a body with a nose portion thereof having mounted thereon a plurality cutting elements protruding from the face of said body for drilling through formation material when said bit is rotated about its axis, the improvement comprising said cutting elements being arranged in first and second sets radially spaced from each other relative to said bit axis, said cutting elements in each of said sets having cutting faces of different sizes with cutting edges spanning relatively small, intermediate and large swaths and having element axes at generally common radial positions relative to the axis of said bit, said cutting faces of said large swath cutting elements in said first and second sets including profile without also substantial profile overlapping of said cutting faces of said small and intermediate swath cutting elements, and said cutting edges of said small, intermediate and large swath cutting elements within each of said sets each having cutting edge tips spaced from the face of said body substantially the same distance.

5. In a drill bit as defined by claim 4, said cutting faces of said large swath cutting elements in said first and second sets having single wear portions outside of said overlapping portions.

6. In a drill bit as defined by claim 5, said body including first and second generally radial wings connected to the face of said body and protruding therefrom in a generally axial direction, said first and second sets of said elements being mounted on said first and second wings, respectively.

7. In a drill bit as defined by claim 6, said body including a third generally radial wing connected to the face of said body and protruding therefrom in a generally axial direction, a third set of cutting

8. In a drill bit as defined by claim 7, said cutting elements on said first wing set being comprised of cutting elements alternating upon progressing radially outwardly from said bit axis between cutting faces with said relatively small and large swath cutting edges, and said cutting elements on said second wing alternating upon progressing radially outwardly between cutting faces with relatively large and small swath cutting edges.

9. In a drill bit as defined by claim 8, said cutting elements on said third wing being comprised of cutting elements with cutting faces having intermediate swath cutting edges.

10. A fixed cutter drill bit having a body with a nose portion thereof having mounted thereon a plurality cutting elements protruding from the face of said body for drilling through formation material when said bit is rotated about its axis, said cutting elements being arranged in first and second sets radially spaced from each other relative to said bit axis, said cutting elements in each of said sets having cutting faces of different sizes with cutting edges spanning relatively small and large swaths and having element axes at common radial positions relative to the axis of said bit, said cutting faces of said large swath cutting elements in said first and second sets including portions thereof overlapping each other in rotated profile without also substantial profile overlapping of said cutting faces of said small swath cutting elements, and said cutting edges of said small and large swath cutting elements in each of said sets being same distance along said axes of said elements.

11. A fixed cutter drill bit having a body with a nose portion having a plurality cutting elements mounted thereon and protruding from the surface thereof for drilling through formation material when said bit is rotated about its axis, said cutting elements being arranged in first and second sets radially spaced from each other relative to said bit axis, said sets each comprising a number of said cutting elements of different sizes with at least one of said different sizes of cutting elements in said set having a cutting face with a cutting edge spanning a relatively small swath for cutting through formation material and another of said cutting elements therein having a cutting face with a cutting edge spanning a relatively large swath for cutting through formation material, within each of said sets said cutting face of said small swath cutting element therein being substantially entirely overlapped in rotated profile by said cutting face of said large swath cutting element therein, and said cutting faces of said large swath cutting elements in said first and second sets including portions thereof overlapping each other in rotated profile without substantial overlapping between said large swath cutting element of one of said first and second sets with the small swath cutting element of the other of said first and second sets.

12. A fixed cutter drill bit as defined by claim 11 wherein at least one of said sets of cutting elements further includes an intermediate swath cutting element having an intermediate size cutting face with a cutting edge spanning an intermediate size swath in rotated profile relative to said small and large swaths, and said cutting face of said small swath cutting element in said at least one set being substantially entirely overlapped in rotated profile by said intermediate size cutting face therein and said intermediate size cutting face being substantially entirely overlapped in rotated cutting element therein.

13. A fixed cutter drill bit as defined by claim 11 wherein at least one of said sets of cutting elements includes a second small swath cutting element radially spaced from said first mentioned small swath cutting element, and said cutting faces of both said first and second small swath cutting elements within said at least one set of cutting elements being substantially entirely overlapped in rotated profile by said cutting face of said large swath cutting element therein.

14. A fixed cutter drill bit as defined by claim 13 wherein said cutting faces of said first and second small swath cutting elements include portions. overlapping each other in rotated profile.

15. A fixed cutter drill bit as defined by claim 13 wherein said cutting faces of said first and second small swath cutting elements are spaced radially from each other within the rotated profile of said large swath cutting element.

16. A fixed cutter bit as defined by claim 11 such that within each of said sets said cutting edges of said large and small swath cutting elements each includes a cutting edge tip, and within at least one of said sets said small swath cutting edge tip being coincident in profile with a portion of said large swath cutting edge.

17. A fixed cutter bit as defined by claim 16 such that in profile said large and small swath cutting edge tips in one of said sets are substantially coincident with each other.

18. A fixed cutter bit as defined by claim 16 such that one of said sets includes at least two of said small swath cutting elements with said two small swath cutting edge tips spaced radially from each other in profile and said large swath cutting edge tip being disposed radially between said two small swath cutting edge tips.

19. A fixed cutter bit as defined by claim 11 such that within each of said sets said cutting edges of said large and small swath cutting elements each including a cutting edge tip, and within at least one of said sets said large and small swath cutting edge tips being spaced from the surface of said bit body different distances.

20. A fixed cutter bit as defined by claim 19 wherein said large swath cutting edge tip is spaced a greater distance from the surface of said body than said small swath cutting edge tip.

21. A fixed cutter drill bit with a body having a plurality of relatively large and small sizes of cutter elements protruding from said body for cutting through formation material when said bit is rotated about its axis, said cutter elements being arranged on said bit other relative to the axis of said body, each of said sets being comprised of a number of said large and small sizes of said cutter elements angularly spaced from each other, said large cutter elements in radially adjacent ones of said sets having profiles partially overlapping each other, and said small cutter elements in each of said sets having profiles located radially relative to the axis of said bit substantially within an annular area circumscribed by the portion of the profile of said large cutter element therein not overlapped by the profile of any radially adjacent cutter element.

22. A fixed cutter drill bit with a body having a plurality of relatively large and smaller sizes of cutter elements protruding from said body for cutting through formation material when said bit is rotated about its axis, said cutter elements being arranged on said bit body in first and second sets radially spaced from each other relative to the axis of said body, each of said sets being comprised of a number of said large and smaller sizes of said cutter elements angularly spaced from each other with said smaller cutter elements therein having profiles located radially relative to the axis of said bit substantially within an annular area circumscribed by the portion of the profile of said large cutter element therein not overlapped by the profile of any cutter element of a radially adjacent set.

* * * * *